US008368536B2

(12) United States Patent
Fawcett et al.

(10) Patent No.: US 8,368,536 B2
(45) Date of Patent: Feb. 5, 2013

(54) MERCHANDISE DISPLAY SECURITY DEVICES INCLUDING ANTI-THEFT FEATURES

(75) Inventors: Christopher J. Fawcett, Charlotte, NC (US); David N. Berglund, Marvin, NC (US)

(73) Assignee: InVue Security Products Inc., Charlotte, NC (US)

( * ) Notice: Subject to any disclaimer, the term of this patent is extended or adjusted under 35 U.S.C. 154(b) by 317 days.

(21) Appl. No.: 12/839,500

(22) Filed: Jul. 20, 2010

(65) Prior Publication Data

US 2012/0019383 A1 Jan. 26, 2012

(51) Int. Cl.
*G08B 13/14* (2006.01)

(52) U.S. Cl. ..... 340/568.1; 340/568.2; 340/568.4; 340/571

(58) Field of Classification Search ..... 340/568.1, 340/568.2, 568.4, 568.8, 571
See application file for complete search history.

(56) References Cited

U.S. PATENT DOCUMENTS

| | | | | |
|---|---|---|---|---|
| 3,423,056 | A | 1/1969 | Welt | |
| 3,932,857 | A | 1/1976 | Way et al. | |
| 4,570,887 | A | 2/1986 | Banister | |
| 4,772,878 | A | 9/1988 | Kane | |
| 5,146,205 | A | 9/1992 | Keifer et al. | |
| 5,151,684 | A | 9/1992 | Johnsen | |
| 5,429,332 | A | 7/1995 | Ishikawa | |
| 5,570,080 | A | 10/1996 | Inoue et al. | |
| 5,604,484 | A * | 2/1997 | Rogers | 340/568.8 |
| 5,861,807 | A | 1/1999 | Leyden et al. | |
| 5,910,768 | A | 6/1999 | Ott | |
| 6,087,939 | A | 7/2000 | Leyden et al. | |
| 6,104,289 | A | 8/2000 | Rand | |
| 6,380,855 | B1 * | 4/2002 | Ott | 340/568.2 |
| 6,515,588 | B1 | 2/2003 | Sarabia | |
| 6,896,543 | B2 | 5/2005 | Fort et al. | |
| 7,209,038 | B1 * | 4/2007 | Deconinck et al. | 340/568.8 |
| 7,327,276 | B1 | 2/2008 | Deconinck et al. | |
| 7,629,895 | B2 * | 12/2009 | Belden et al. | 340/693.5 |
| 7,710,266 | B2 * | 5/2010 | Belden et al. | 340/568.3 |
| 7,737,843 | B2 | 6/2010 | Belden, Jr. et al. | |

(Continued)

FOREIGN PATENT DOCUMENTS

| | | |
|---|---|---|
| TW | 563861 | 11/2003 |
| WO | 2008087409 A1 | 7/2008 |

OTHER PUBLICATIONS

"Notification of Transmittal of International Search Report and Written Opinion of the International Searching Authority, or the Declaration" in counterpart International Patent Application No. PCT/US2011/040429; 16 pages.

*Primary Examiner* — Toan N Pham
(74) *Attorney, Agent, or Firm* — Christopher C. Dremann, P.C.

(57) ABSTRACT

Exemplary embodiments of merchandise display security devices including anti-theft features for preventing theft of an item of merchandise being displayed in a display area of a retail store are shown and described. The security devices provide a dual alarm merchandise security system including an alarm unit attached to the item of merchandise and electrically and mechanically connected to a fixed unit that is attached to a fixed support within the display area. The alarm unit and the fixed unit each include an alarm that is activated by a control circuit upon predetermined alarm conditions. A breakaway cable interconnects the alarm unit and the fixed unit and defines a sense loop therebetween. In one embodiment, the fixed unit is a display stand and the alarm unit is a sensor configured to be removably supported on the display stand.

22 Claims, 9 Drawing Sheets

U.S. PATENT DOCUMENTS

| | | | | |
|---|---|---|---|---|
| 7,737,845 | B2 | 6/2010 | Fawcett et al. | |
| 7,744,404 | B1 | 6/2010 | Henson et al. | |
| 8,013,740 | B2 * | 9/2011 | Irmscher et al. | 340/568.1 |
| 2006/0097875 | A1 | 5/2006 | Ott | |
| 2006/0145848 | A1 | 7/2006 | Marsilio et al. | |
| 2007/0120669 | A1 | 5/2007 | Belden, Jr. | |
| 2007/0146134 | A1 | 6/2007 | Belden et al. | |
| 2007/0152819 | A1 | 7/2007 | Marszalek et al. | |
| 2007/0159327 | A1 | 7/2007 | Belden et al. | |
| 2007/0171061 | A1 | 7/2007 | Belden | |
| 2008/0169923 | A1 | 7/2008 | Belden et al. | |
| 2008/0204239 | A1 | 8/2008 | Marszalek et al. | |
| 2009/0058643 | A1 | 3/2009 | Groth | |
| 2010/0176945 | A1 | 7/2010 | Fawcett et al. | |

* cited by examiner

MERCHANDISE DISPLAY SECURITY DEVICES INCLUDING ANTI-THEFT FEATURES

FIELD OF THE INVENTION

The invention relates to merchandise display systems, and more particularly, to merchandise display security devices including anti-theft features for displaying and protecting an item of merchandise.

BACKGROUND OF THE INVENTION

Operators of retail stores continue to seek display systems for protecting merchandise subject to shoplifting. This is particularly true for handheld electronic items such as digital cameras, portable digital devices, handheld computers, laptop computers, and portable phones. However, the increased security must not interfere with the ability of a potential purchaser to physically examine and, in some instances, to operate the merchandise. Merchants have found that displaying such electronic items in a glass cabinet secured by a lock decreases sales because customers feel uncomfortable asking a sales associate to unlock the cabinet. Many customers will avoid a purchase all together rather than seeking the assistance of a sales associate and evaluating the item under the scrutiny of the sales associate. Merchants, therefore, desire merchandise display security devices that allow potential purchasers to freely examine and operate a display item, while preventing a shoplifter from removing the display item from the display area.

Various merchandise display security devices for protecting items of merchandise at a display area are known in the art. One such device provides each item of merchandise with an electronic article surveillance (EAS) tag that activates an alarm if the item is passed through a sensor located at the exit of the retail store without the tag being removed or deactivated. However, EAS tags have significant drawbacks. First, a shoplifter may simply grab one or more expensive items and quickly leave the store, potentially activating the alarm, but making a fast getaway. Second, a shoplifter may separate the EAS tag from the item since it is difficult to secure an EAS tag to smaller items of merchandise, for example a cellular phone.

Other merchandise display security devices utilize a mechanical cable to secure the item of merchandise to a fixed support within the display area. The mechanical cable acts as a tether, preventing the item from being removed from the display area, while having a sufficient length to provide freedom of movement for a potential customer to evaluate the item. In some instances, the mechanical cable further includes an electrical sense loop and an audible or visible alarm that is activated if a shoplifter cuts or otherwise shorts the sense loop, removes the cable from its anchored position on the fixed support, or removes the item of merchandise from the cable. However, mechanical cable-based devices likewise have significant disadvantages. Shoplifters may defeat the mechanical cable, or its connection to the fixed support or to the item of merchandise, then conceal the item and quickly leave the display area. Although an alarm in the display area might be activated, the shoplifter may be able to exit the display area undetected unless a store employee actually observed the shoplifter concealing the item and leaving the display area.

Therefore, there is a need for improved merchandise display systems for protecting an item of merchandise from theft. There exists a further and more specific need for merchandise display security devices including anti-theft features that prevent a shoplifter from easily separating an item of merchandise from the device. There exists a particular need for a merchandise display security device including anti-theft features that prevents a shoplifter from defeating the device and then concealing an item of merchandise and leaving a display area undetected.

SUMMARY OF THE INVENTION

In one aspect, the present invention provides a merchandise display security device for displaying and protecting an item of merchandise including a breakaway cable and an alarm in which the alarm remains attached to the item of merchandise if the item is separated from the cable or is removed from a display area.

In another aspect, sensing switches are positioned in different predetermined regions around the outer perimeter of a merchandise display security device. The sensing switches actuate an alarm without delay, regardless of which of the switches around the perimeter of the device are tampered with by a potential shoplifter.

In yet another aspect, the present invention provides a merchandise display security device including at least two alarms that each sound at a different frequency to alert a sales associate or other store employee of an attempted theft. A first alarm remains attached to the item of merchandise and emits sound at a first frequency, while a second alarm remains secured to a fixed support within the display area and emits sound at a second frequency.

In yet another aspect, the present invention provides a merchandise display security device including a sensor having a post that serves as a shroud for a registered jack (RJ) connection so that an RJ plug configured to be received by an RJ jack to form the RJ connection requires a special tool to disconnect the RJ plug from the RJ jack.

In yet another aspect, the present invention provides a merchandise display security device including an alarm unit for attachment to an item of merchandise by way of a threaded fastener for engaging an internally threaded recess that is typically provided on a displayed item of merchandise, such as a camera, camcorder, digital video recorder (DVR), and the like.

In yet another aspect, the present invention provides a merchandise display security device including means for powering a displayed item of merchandise so as to permit a potential purchaser to examine and operate the item of merchandise in a powered state.

In yet another aspect, the present invention provides a merchandise display security device including means for arming and disarming a first alarm that remains attached to the item of merchandise and a second alarm that remains attached to a fixed support at a display area in the event that a cable interconnecting the first alarm and the second alarm is severed or is disconnected. In one embodiment, the first alarm and the second alarm are armed and disarmed using a programmable key.

The foregoing, as well as other objectives and advantages of the invention and the manner in which the same are accomplished, are further exemplified by the following detailed description and its accompanying figures.

DETAILED DESCRIPTION OF VARIOUS EMBODIMENTS OF THE INVENTION

Merchandise display systems as shown and described herein utilize multiple security components that are configured to attach to an item of merchandise and to a fixed support within a display area, for example a display counter, shelf, table or other fixture, at a display area in a retail store. Each merchandise display system is embodied by a merchandise display security device comprising an alarm unit housing a first alarm that attaches directly to the item of merchandise. The alarm unit, including the first alarm, remains attached to the merchandise if a potential shoplifter attempts to remove the item from the display area. A fixed unit connects to the fixed support within the display area of the retail store. The fixed unit remains attached to the fixed support at the display area if the item of merchandise and the alarm unit are separated from the fixed unit. The merchandise display security device provides a means for tracking the merchandise by emitting an audible alarm from the first alarm that identifies the location of the merchandise as a potential shoplifter departs the display area. The merchandise display security device further comprises a control circuit that transmits control data between the fixed unit and the alarm unit to ensure that the first alarm is activated in response to predetermined alarm conditions.

Certain aspects of merchandise display security devices according to the present invention are compatible with conventional merchandise display systems. For example, a merchandise display security device disclosed herein is suitable for use with the merchandise display system shown and described in the commonly owned U.S. Pat. No. 7,737,843, entitled "PROGRAMMABLE ALARM MODULE AND SYSTEM FOR PROTECTING MERCHANDISE," the disclosure of which is incorporated herein by reference in its entirety.

Figure 1:
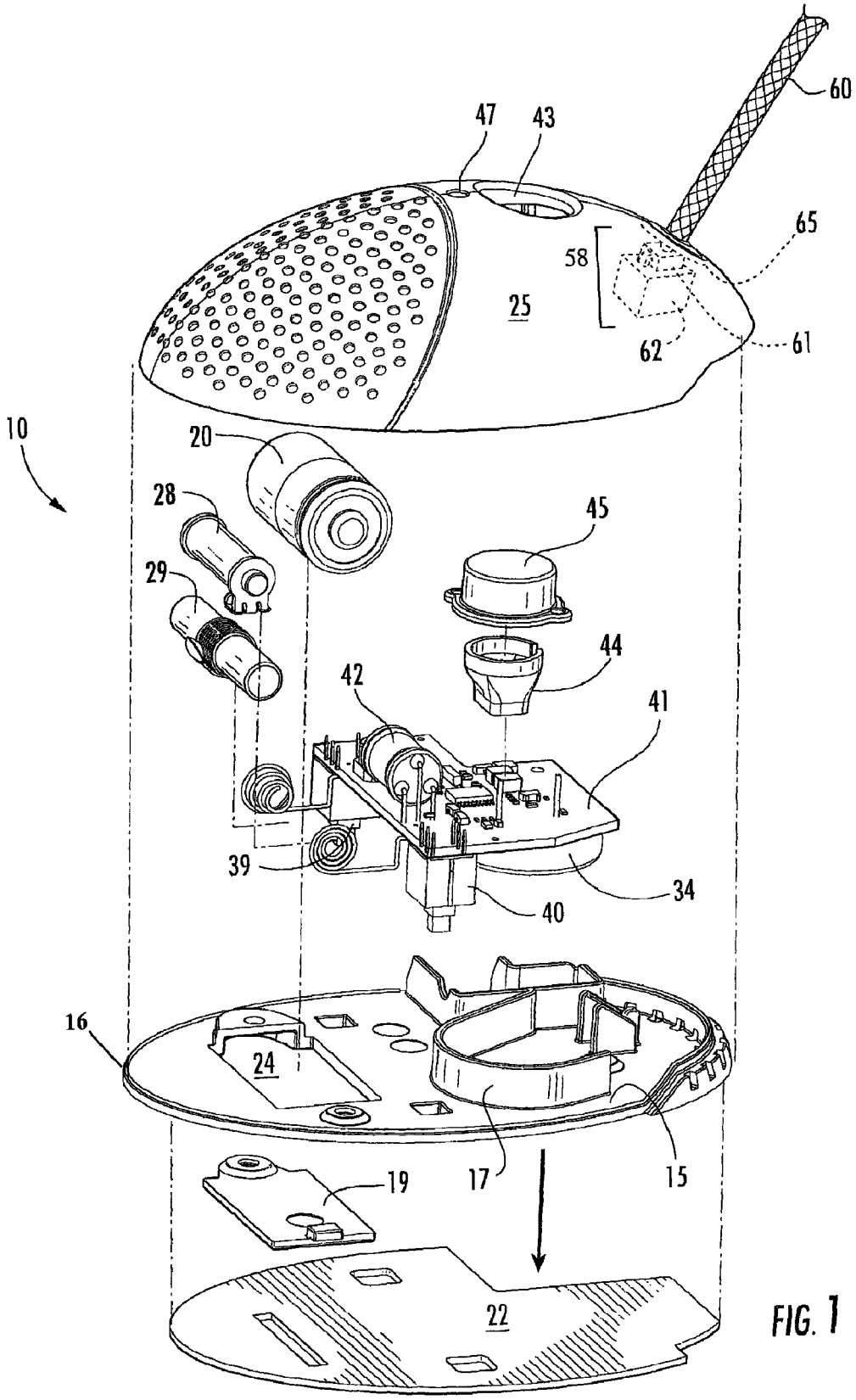
FIG. 1 is an exploded perspective view of an exemplary embodiment of an alarm unit for a merchandise display security device according to the present invention.
Figure 2A:
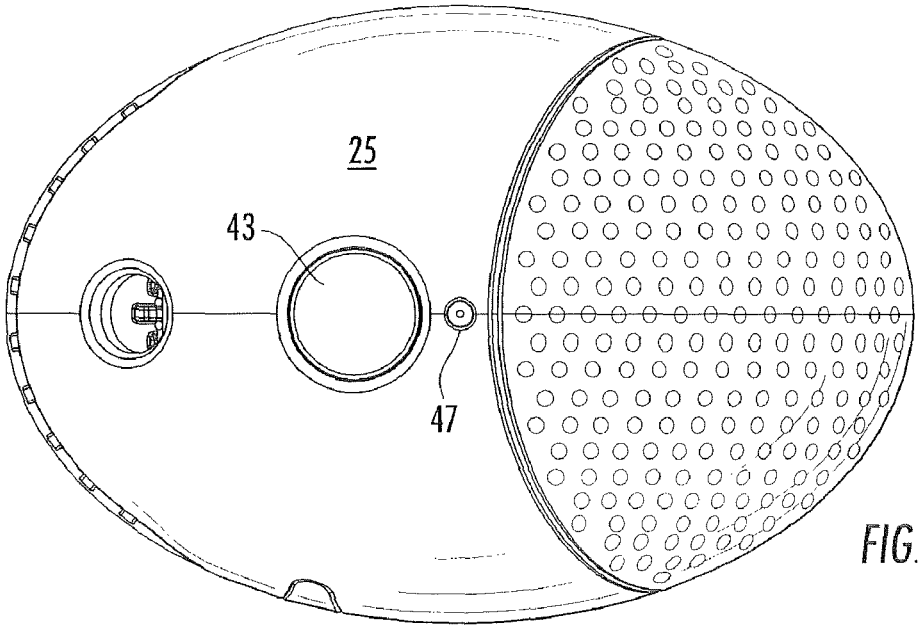
FIG. 2A is a top plan view of the alarm unit of FIG. 1.
Figure 2B:
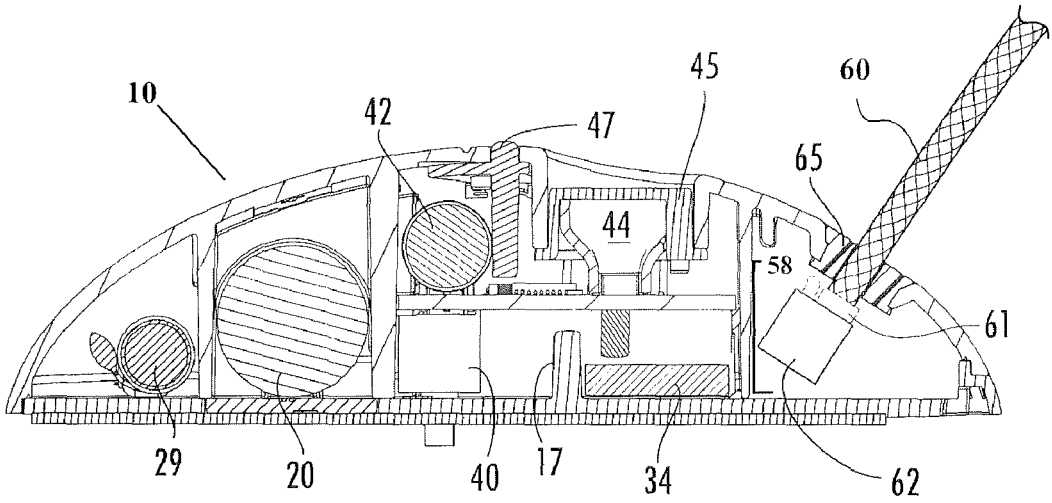
FIG. 2B is a vertical sectional view of the alarm unit of FIG. 1.
Figure 3:
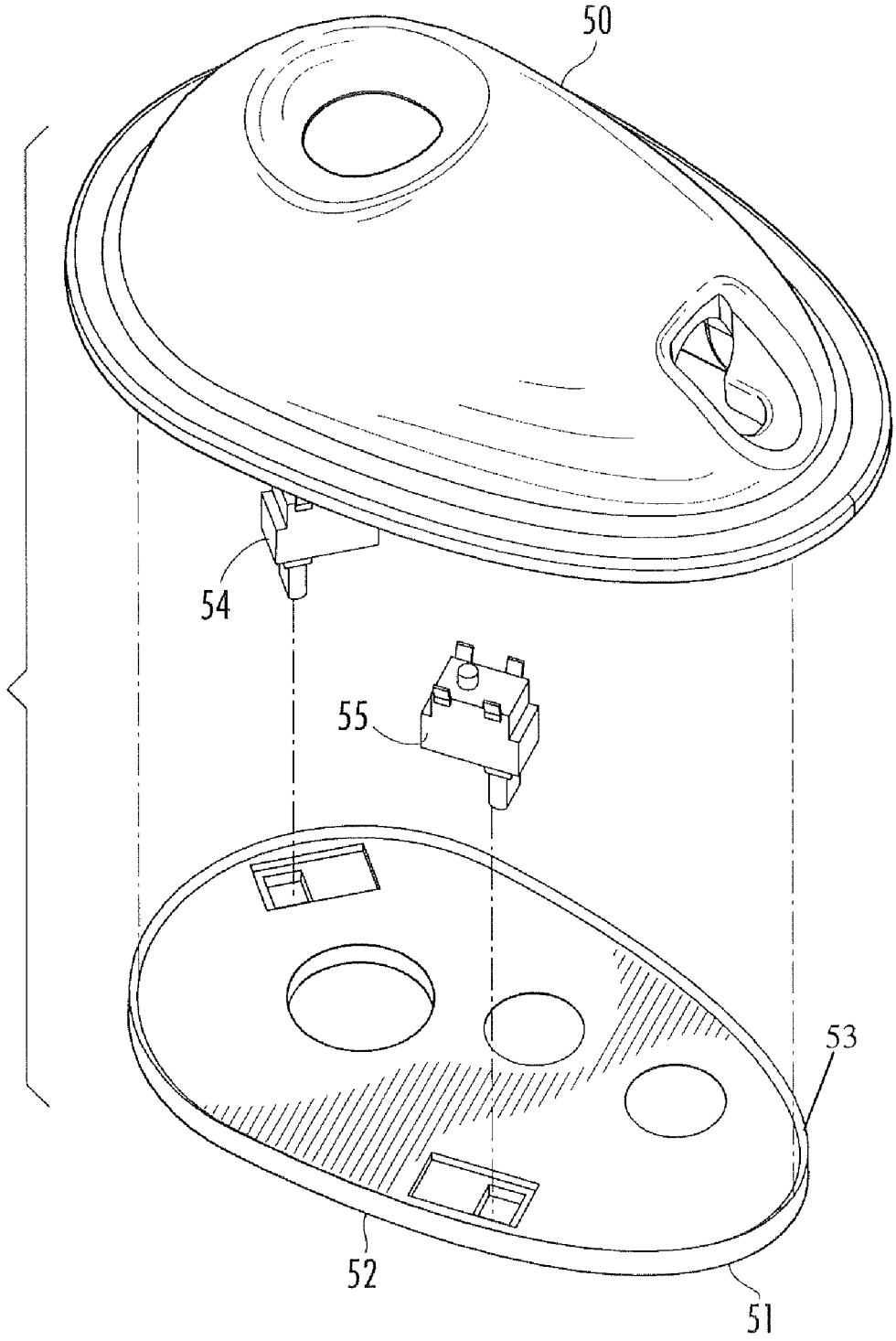
FIG. 3 is an exploded perspective view of an exemplary embodiment of a fixed unit for a merchandise display security device according to the present invention.
Figure 4A:
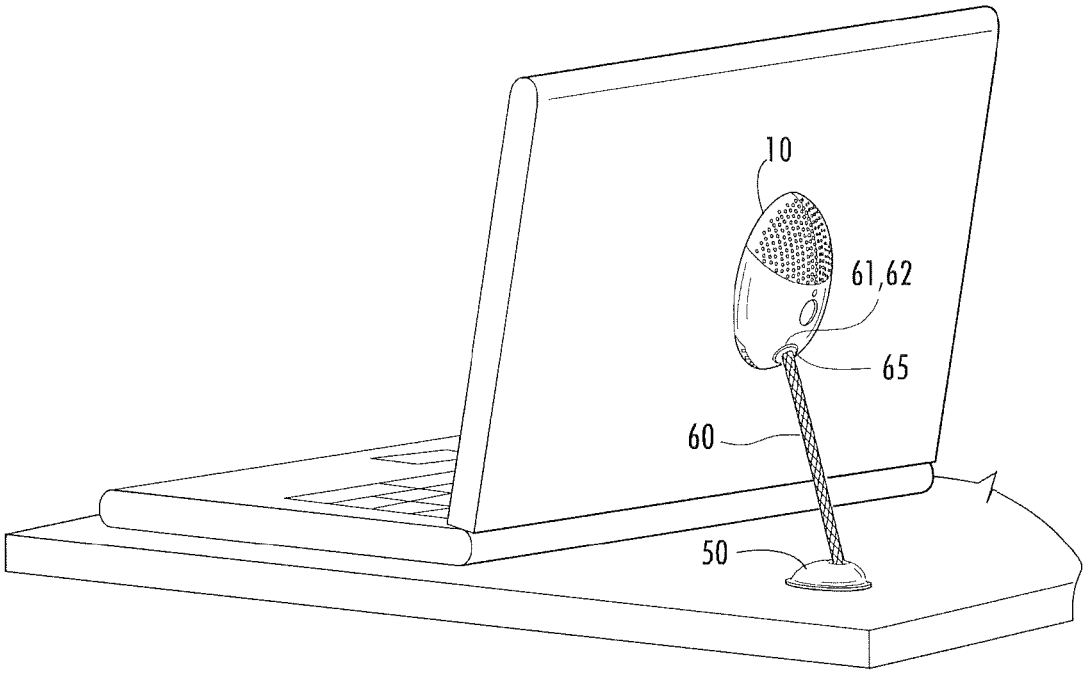
FIG. 4A depicts a first exemplary embodiment of a merchandise display security device according to the present invention shown attached to an item of merchandise and to a fixed support at a display area.
Figure 4B:
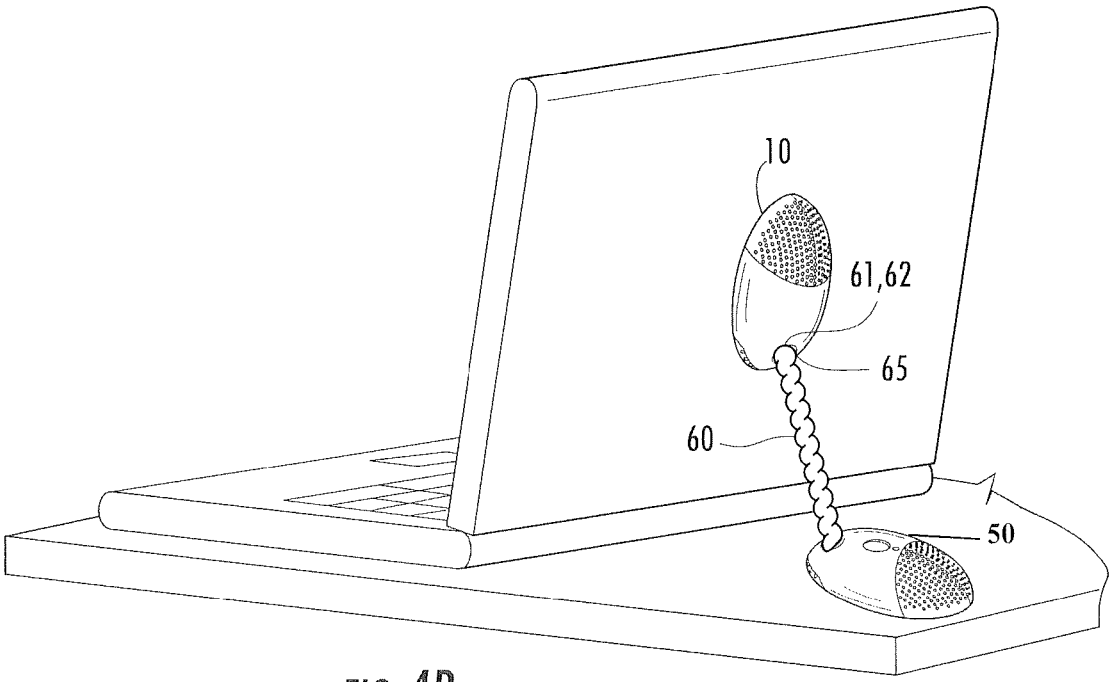
FIG. 4B depicts a second exemplary embodiment of a merchandise display security device according to the present invention shown attached to an item of merchandise and to a fixed support at a display area.

FIGS. 1, 2A, 2B, 3 and 4A depict a first exemplary embodiment of a merchandise display security device in accordance with the present invention. In the exemplary embodiments shown and described herein, and without limiting the invention in any manner, a merchandise display security device comprises (i) an alarm unit 10 configured to be attached to an item of merchandise; and (ii) a fixed unit 50 configured to be attached to a fixed support, such as a display counter, table, shelf or other fixture. FIGS. 1, 2A, and 2B show an exemplary embodiment of the alarm unit 10, while FIG. 3 shows an exemplary embodiment of the fixed unit 50. FIG. 4A illustrates an alarm unit 10 attached to an item of merchandise (i.e., a conventional laptop computer) and electrically connected with a fixed unit 50 attached to a fixed support (i.e., a display counter). FIG. 4B illustrates a second exemplary embodiment of a merchandise display security device comprising an alarm unit 10 electrically connected with a second alarm unit as the fixed unit 50. The second alarm unit 50 comprises a control circuit for monitoring a second alarm in the second alarm unit attached to the fixed support that is similar to the control circuit for monitoring the first alarm in the first alarm unit 10 attached to the merchandise. Both of the embodiments shown in FIG. 4A and FIG. 4B utilize an electrical conduit, referred to herein generically as cable 60, that extends between the alarm unit 10 and the fixed unit 50, or alternatively, between the first alarm unit 10 and the second alarm unit 50. The cable 60 is configured to provide a sense loop providing electrical communication between the alarm unit 10 and the fixed unit 50, or alternatively, between the first alarm unit 10 and the second alarm unit 50.

As shown in FIGS. 1, 2A, and 2B, the alarm unit 10 includes a generally planar housing bottom plate 15 and a housing top 25 having an arming port 43 formed therethrough. In one embodiment, the housing top 25 is generally dome-shaped, but numerous other shapes and configurations are considered to be within the scope of the present invention. The housing bottom plate 15 may be attached to an item of merchandise as illustrated in FIG. 4A, or to a fixed support as illustrated in FIG. 4B, by a pressure sensitive adhesive pad 22. The arming port 43 provides access to electronics on a control circuit 41 disposed within the alarm unit 10 configured for turning the unit on and off (referred to in the art as "arming" and "disarming"), and for updating software provided on the control circuit. The arming port receives data from an external source, for example an infrared (IR) programmable key, as discussed below.

Cable 60, also described in greater detail below, is preferably a breakaway cable that extends from the housing top 25 at a breakaway connection. In the exemplary embodiments shown and described herein, and without limiting the invention in any manner, the breakaway cable 60 provides a conduit for electrical transmission of both power and data, as well as a mechanical tether for physically securing an item of merchandise attached to alarm unit 10 to a fixed support. As used herein, the term "breakaway" is intended to include numerous kinds of cables and connections that are designed to permit the cable to readily detach from the alarm unit 10, or alternatively, from the fixed unit 50 upon application of a pulling force that is less than sufficient to separate the alarm unit 10 from the item of merchandise or the fixed unit 50 from the fixed support. In this regard, a breakaway cable 60 may be designed to separate from a connection with the alarm unit 10 or from a connection with the fixed unit 50, or both, upon application of a force having a preselected magnitude and/or direction (i.e., a "separating force"). The preselected separating force is taken into account in determining the physical features of the cable 60 and its connection at one end with the alarm unit 10 and at the other end with the fixed unit 50.

Figure 5:
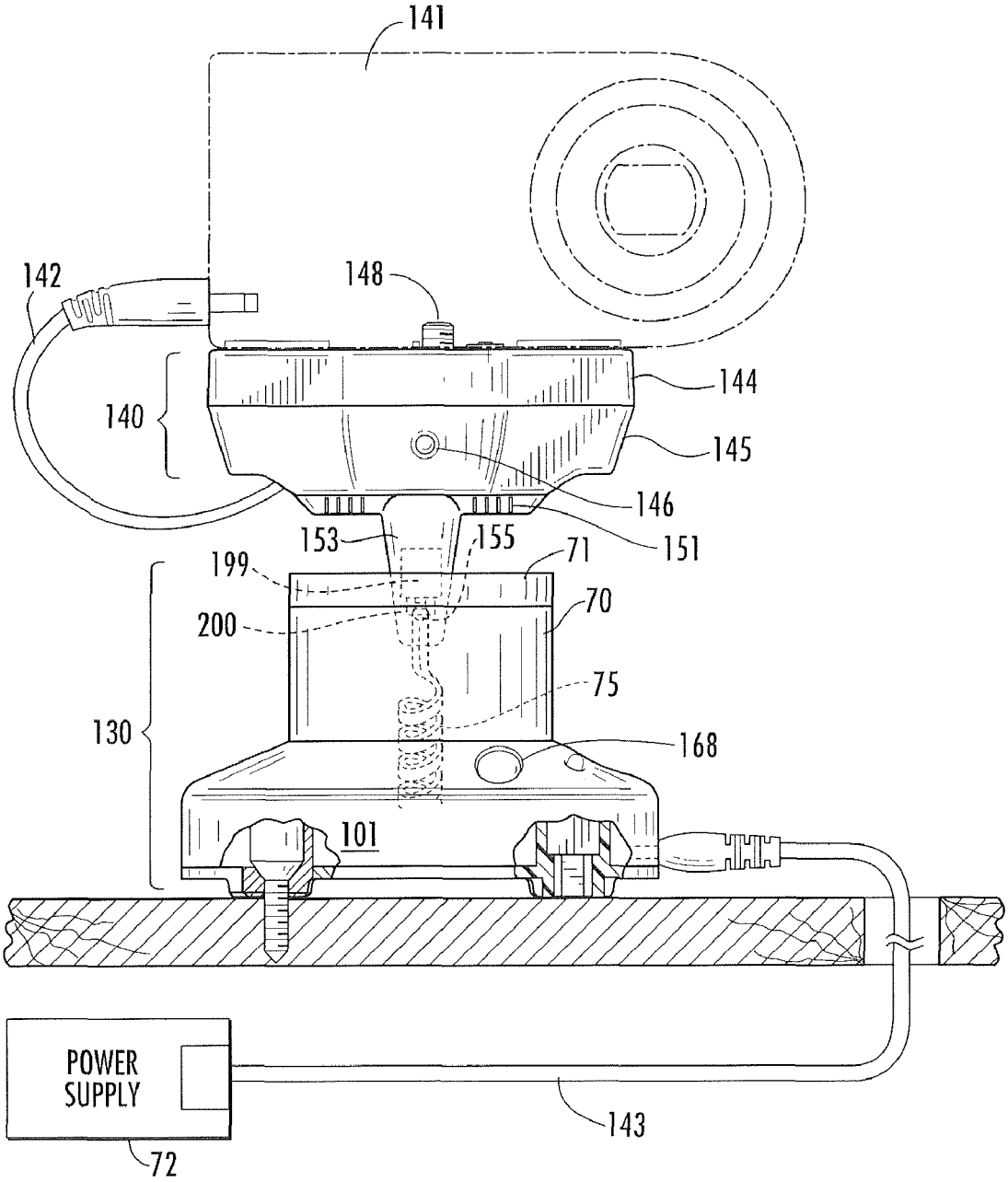
FIG. 5 depicts a third exemplary embodiment of a merchandise display security device according to the present invention shown attached to an item of merchandise and to a fixed support at a display area.

Breakaway cable 60 can be of various constructions, such as a braided metal cable (e.g., FIG. 4A) or a helical coil cable similar to a telephone handset cable (e.g. FIG. 4B and FIG. 5). Regardless, cable 60 preferably comprises one or more electrical conductors (not shown) that extend between, for example, end connections at alarm unit 10 and fixed unit 50. Although a breakaway cable 60 is used in the exemplary embodiments shown and described herein, other suitable means known within the art may be utilized to provide an optical or electrical communications conduit and/or a mechanical tether between the alarm unit 10 and the fixed unit 50. For example, wireless communications with or without a mechanical tether is also considered to be within the scope of the present invention.

As previously mentioned, FIG. 1 is an exploded perspective view of an exemplary embodiment of an alarm unit for a merchandise display security device according to the present invention. Housing bottom plate 15 supports the control circuit 41 within housing top 25. A battery 20 provides power to the alarm unit 10 and is accessible through an opening 24 formed through the housing bottom plate 15. The battery 20 is secured within the alarm unit 10 by a removable door 19 and is electrically connected to the control circuit 41 in a conventional manner to provide electrical power to the components of the alarm unit 10.

As shown, control circuit 41 is mounted on an interior surface of housing bottom plate 15 and includes electronic components that are well known to those skilled in the art of control systems. In an exemplary embodiment, the control circuit 41 may include a transformer 42 to increase the voltage from battery 20 to a voltage that is sufficient to power an alarm, such as a piezoelectric alarm 34.

Alarm unit 10, and in particular housing top 25, includes an arming port 43 for communicating with control circuit 41, or alternatively, with optical or electrical components that are in communication with control circuit 41. Without limiting the present invention in any manner, a conventional means for communicating with control circuit 41 incorporates infrared (IR) technology for short range data transmission. Communication via IR data transmission allows for turning on (arming), turning off (disarming), and programming the control circuit 41 of the alarm unit 10 utilizing an appropriate data security protocol. The arming port 43 is configured to receive IR transmissions from an external source such as a portable transmitter, referred to herein as a "programmable key" or simply a "key". The programmable key substantially aligns with an IR lens 45 disposed within the housing top 25. A programmable key that could be used with merchandise display security devices in accordance with the present invention is shown and described in the commonly owned U.S. Pat. No. 7,737,845, entitled "PROGRAMMABLE KEY FOR A SECURITY SYSTEM FOR PROTECTING MERCHANDISE," the disclosure of which is incorporated herein by reference in its entirety.

The arming port 43 permits wireless communication with a logic control circuit on a microprocessor or central controller (not shown) disposed on the control circuit 41. The arming port 43 is configured to receive an operating signal, for example an infrared (IR) signal, a radio frequency (RF) signal, or an electromagnetic or magnetic pulse generated by an energy source, from a key programmed with the operating signal. The arming port 43 transmits the operating signal from the key to the central controller initially to program, and then subsequently, to arm or disarm the alarm unit 10 of the merchandise display security device. An ambient light blocker, or filter, 44 may be mounted adjacent the IR lens 45 or the control circuit 41 to minimize disruptions to the IR operating signal caused by an external light source.

The control circuit 41 is connected to and in electronic communication with at least one electronic proximity switch 39, 40 within the alarm unit 10. In one embodiment, the switch 39, 40 is a conventional limit, contact or plunger switch that is compressed inwardly (i.e., closed) when the housing bottom plate 15 is positioned against an item of merchandise, as illustrated in FIG. 4A. Removing the alarm unit 10 from the item of merchandise by lifting the pressure sensitive adhesive 22 or the housing bottom plate 15 actuates the plunger switch 39, 40 to open a sense loop that causes the control circuit 41 to activate the audible alarm 34. In one embodiment, the audible alarm 34 is a piezoelectric alarm that is electrically connected to control circuit 41.

In one embodiment, at least two plunger switches 39, are positioned at different locations around the outer perimeter of the housing bottom plate 15 so that the alarm unit 10 is more resistant to tampering, and in particular, is more sensitive to an attempt to detach the alarm unit 10 from the item of merchandise, as illustrated in FIG. 4A, or from the fixed support, as illustrated in FIG. 4B. The switches 39, 40 are preferably positioned adjacent an edge of the alarm unit 10 so that at least one of the switches will be actuated without delay, regardless of which region around the perimeter of the housing bottom plate 15 a potential shoplifter first attempts to detach the pressure sensitive adhesive from the item of merchandise or the fixed support. The position of the switches 39, 40 may be tailored to a particular installation, but generally the switches are most responsive to tampering if they are positioned medially between the center of the housing bottom plate 15 and the outer perimeter of the alarm unit 10. In one embodiment, the switches 39, 40 are positioned closer to the outer perimeter of the alarm unit 10 than to the center of the housing bottom plate 15, and if desired, the switches may be placed directly adjacent an outer edge of the housing bottom plate of the alarm unit. The position of the switches 39, 40 are equally pertinent to the fixed unit 50, which may also incorporate electronic proximity switches for activating an alarm, as will be described.

Strategically positioning multiple plunger switches adjacent the outer edge on the bottom of the alarm unit 10 and/or the fixed unit 50 allows for faster and more efficient activation of a respective alarm than would be the case in merchandise display security devices having one or more switches located closer to the center. For example, FIG. 3 shows an exemplary embodiment of a fixed unit 50 in which plunger switches 54, 55 are positioned around the outer perimeter 51 of a fixed unit base plate 53 so as to activate an audible alarm (e.g., alarm 34 in alarm unit 10) when a potential shoplifter tampers with the fixed unit along an outer edge of the fixed unit base plate. The plunger switches 54, 55 extend outwardly from the bottom side of the fixed unit base plate 53 at peripheral positions located generally across from one another so as to protect both sides of the fixed unit 50 from tampering.

Whether the plunger switches 39, 40, 54, 55 are utilized in an alarm unit 10 or a fixed unit 50, placing the switches closer to an outer edge of the unit and at spaced apart peripheral positions located around the outer perimeter of a bottom portion of the unit protects the merchandise display security device when a potential shoplifter attempts to defeat the merchandise display system. For example, a potential shoplifter may attempt to slide a flat surface, such as a razor blade, knife or other relatively thin object, under the alarm unit 10 or fixed unit 50 to retain a switch 39, 40, 54, 55 in a depressed (i.e., closed) state against the flat surface. In this manner, the potential shoplifter substitutes the intruding flat surface for the item of merchandise or the fixed support to which the alarm unit 10 or fixed unit 50, respectively, was attached. This tactic prevents the switch from being extended (i.e., opened) and activating the audible alarm 34 via the control circuit 41. In the exemplary embodiments shown and described herein, however, the locations of the plunger switches 39, 40, 54, 55 defeats such a tactic because even if a first one of the plunger switches fails to activate the alarm, a second one of the plunger switches will be actuated (i.e., extended) and cause the audible alarm 34 to sound. Positioning the plunger switches 39, 40, 54, 55 substantially opposite one another allows for the alarm unit 10 or fixed unit 50 to sense an attempt to detach the unit from multiple angles, making it significantly more difficult for a potential shoplifter to defeat both of the switches simultaneously.

Another anti-theft feature of the merchandise display security devices shown and described herein is the use of a breakaway cable 60. FIG. 1 and FIG. 2B show that the control circuit 41 in the alarm unit 10 is electrically connected to breakaway cable 60 through a terminating RJ connection 58 comprising an RJ plug 61 attached to an end of the breakaway cable and an RJ jack 62 mounted within the alarm unit 10. The RJ connection 58 allows for electronic communication between the alarm unit 10 and a fixed unit 50 (as illustrated in FIG. 4A), or alternatively, between a first alarm unit 10 and a second alarm unit 50 (as illustrated in FIG. 4B), via the cable 60. A specially designed resilient relief grommet 65 at the RJ connection 58 provides strain relief so that the mechanical and electrical connection between the alarm unit 10 and the breakaway cable is broken at a preselected level of tension or stress. By way of example and without limiting the present invention in any manner, in one embodiment the RJ plug 61 of the breakaway cable 60 separates from the grommet 65 of the alarm unit 10 if a force greater than a maximum stress tolerance of the RJ connection 58 is applied to the cable in a direction opposite the force retaining the RJ plug 61 within the compatible RJ jack 62. Furthermore, an RJ connection 58 and a resilient relief grommet 65 may be constructed at either or both ends of the breakaway cable 60 between an alarm unit 10 and the breakaway cable, or between a fixed unit 50 and the breakaway cable.

In one embodiment, and without limiting the scope of the present invention in any manner, the breakaway cable 60 separates from the RJ connection 58 and the resilient relief grommet 65 if a separating force having a magnitude within a range of about 10 pounds to about 20 pounds is applied in a direction opposing the forces collectively retaining the RJ plug 61 within the RJ jack 62. As previously described, a similar breakaway grommet 65 may be utilized to likewise provide a breakaway feature at an RJ connection 58 on the fixed unit 50 (not shown). Although a breakaway grommet 65 is used to provide the breakaway feature in the exemplary embodiments, other suitable means known within the art may be utilized as well to supply the same or similar function.

The breakaway feature is particularly useful to activate an audible alarm if a sense loop in the breakaway cable 60 is interrupted by a potential shoplifter severing the breakaway cable or disconnecting the breakaway cable from either the alarm unit 10 or the fixed unit 50. Breakaway cable 60 preferably includes one or more electrical conductors transmitting data signals and/or power signals between an alarm unit 10 and a fixed unit 50 (or between a first alarm unit 10 and a second alarm unit 50) so that the control circuit 41 monitors the status and integrity of the breakaway cable 60. Data communication via the breakaway cable 60, therefore, provides a means to activate (i.e., sound) an audible alarm 34 if the breakaway cable 60 is disconnected from resilient relief grommet 65, as described above, or alternatively, is severed by a potential shoplifter.

The breakaway cable 60 is one part of an overall sensing circuit, also referred to herein as "sense loop", extending between an alarm unit 10 and a fixed unit 50 (or between a first alarm unit 10 and a second alarm unit 50). The sensing circuit is designed to electronically monitor the switches 39, 40 in the alarm unit 10, the switches 54, 55 in the fixed unit 50, and the integrity of the breakaway cable 60 or the RJ connection 58. The sensing circuit communicates with a logic control circuit in either or both the alarm unit 10 and the fixed unit 50 to activate an audible alarm upon predetermined alarm conditions that indicate unauthorized tampering with the merchandise display security device or the item of merchandise.

As such, audible alarm 34 is electrically connected to breakaway cable 60 via the control circuit 41. Control circuit 41 may be implemented in numerous circuit board designs, such as printed circuit board (PCB) or computer chip, that are equally effective in monitoring the status of the plunger switches 39, 40, 54, 55 and the breakaway cable 60. The PCB or computer chip implementing the control circuit 41 may be programmed to detect a change in the status of any one of the switches 39, 40, 54, 55, or the loss of data communications at any point along the breakaway cable 60.

Returning to FIG. 1, the alarm unit 10 disclosed herein may include additional components, such as an LED 47 electrically connected to control circuit 41 and operable for indicating the "armed" or "disarmed" status of the alarm unit. The LED 47 emits a light output through a lens mounted in the housing top 25 intended to indicate to a potential shoplifter that the merchandise display security device is armed and an alarm will be activated upon an attempt to steal the item of merchandise. As such, the LED 47 serves as a theft deterrent. The alarm unit 10 may also include an electronic article surveillance (EAS) tag in the form of an acoustic-magnetic (AM) device 28 and a radio frequency (RF) coil 29. The EAS tag provides a secondary alarm opportunity in the event that the alarm unit 10 passes through sensors located at an exit of the store configured to detect a signal from the EAS tag. If desired, an LED and/or an EAS tag may likewise be provided on the fixed unit 50 in the event that the fixed unit remains attached to the item of merchandise via the breakaway cable 60 and the alarm unit 10.

The alarm unit is configured to be readily attached to or mounted on numerous types of merchandise through the use of the pressure sensitive adhesive 22. Similarly, the fixed unit 50 (or a second alarm unit 50) is configured to be readily attached to or mounted on a variety of different fixed supports, also commonly referred to as a display surface or display support, such as a countertop, table, shelf, etc., using a pressure sensitive adhesive or other form of adhesive layer, indicated generally at 52 in FIG. 3. In the attached or mounted position shown in FIG. 4A, plunger switches 39, 40 of alarm unit 10, breakaway cable 60, and plunger switches 54, 55 of fixed unit 50 will activate an audible alarm upon tampering, as previously described. Events leading to a predetermined alarm condition include, but are not limited to, removal of the item of merchandise from the housing bottom plate 15, severing of breakaway cable 60, forceful removal of breakaway cable 60 from resilient relief grommet 65 at the RJ connection 58, or removal of the fixed unit 50 from the fixed support. As noted above, the predetermined alarm conditions may also include merely lifting an outer edge of the alarm unit 10 from the item of merchandise or lifting an outer edge of the fixed unit 50 from the fixed support.

As previously described, FIG. 3 and FIG. 4A illustrate that the fixed unit 50 may incorporate switches for monitoring an attempt to detach the fixed unit 50 from a fixed support within a display area. In an alternative embodiment illustrated in FIG. 4B, the fixed unit of the merchandise display security device is replaced with a second alarm unit 50 that is identical or substantially similar to first alarm unit 10 attached to the item of merchandise. The second alarm unit 50 likewise contains a battery 20, a control circuit 41 and an audible alarm 34, as previously described. In this alternative embodiment, a dual alarm system may be utilized to sound an audible alarm at both the location of the item of merchandise and the location of the fixed support within the display area. Thus, if the sense loop extending between the alarm units 10, 50 through the breakaway cable 60 is interrupted, two different audible alarms will be activated; namely, a first alarm (referred to herein as the merchandise alarm) within the alarm unit 10 attached to the merchandise and a second alarm (referred to herein as the fixed alarm) within the second alarm unit 50 attached to and remaining at the fixed support within the display area. The merchandise alarm tracks the merchandise as the potential shoplifter attempts to leave the display area with the merchandise, while the fixed alarm alerts store personnel that a theft has been attempted within the display area. In this manner, the potential shoplifter can be identified by the sound of the merchandise alarm that remains attached to the item of merchandise as the shoplifter attempts to leave the display area with the merchandise.

The "dual alarm system" merchandise display security devices disclosed herein are configured to prevent the first alarm (merchandise alarm) and the second alarm (the fixed alarm) from interfering with one another. In this regard, the merchandise alarm and the fixed alarm may be configured to minimize sound interference and sound wave cancellation that could occur if the alarms emitted sound waves having overlapping phases. In order to avoid waveform interference based upon the interaction of sound waves that track one another with offset or inverted phases, the alarms may be set at distinct audible frequencies having distinct phases. This feature may be managed by the control circuit 41 of each respective alarm unit 10, 50 transmitting a unique input to its corresponding alarm 34 for a predetermined output sound that is unique to the respective alarm. As a result security personnel would be alerted to the location of the merchandise by a first alarm 34 within the first alarm unit 10 attached to the merchandise that emits sound at a first frequency. Meanwhile, a second alarm 34 will emit sound at a second frequency from the second alarm unit 50 at the location of the fixed support within the display area from which the item of merchandise was removed.

In yet another exemplary embodiment, the merchandise display security device may be further described as including a programmable alarm module within the control circuit 41 that controls components of the system. In one embodiment, the programmable alarm module could be incorporated into any of the merchandise display security devices described above by installing the programmable alarm module into at least one alarm unit 10. The programmable alarm module communicates with the fixed unit 50 (see FIG. 4A), or alternatively, the alarm module of the second alarm unit 50 communicates with the first alarm unit 10 (see FIG. 4B), by transmitting data across the breakaway cable 60. In this embodiment, the arming port 43 would be a data entry device for store personnel to initiate communications with the alarm unit 10, 50 via a portable transmitter or programmable key, as described above. The arming port 43 receives the operating signal and transmits the operating signal to the programmable alarm module, allowing the alarm module to perform system checks, sense circuit conditions, activate an audible alarm, and ultimately, to arm and disarm the merchandise display security device as desired.

Merchandise security systems often, but are not required to, incorporate more than one component, such as the alarm unit 10 and the fixed unit 50 connected by a breakaway cable 60 described above. Other merchandise security systems having multiple components may utilize a vertical design elevating merchandise for public display in a secure manner, as described below and shown with reference to FIGS. 5-9. Typically, these kinds of merchandise security systems incorporate a display stand 130 supporting a sensor 140 that is configured to attach to an item of merchandise. In the aforementioned embodiment, as well as others that are within the scope of the invention, the merchandise security system utilizes data and power transmission from one component to another in an overall dual alarm system. The term "component," therefore, as used herein with reference to merchandise security systems, includes, but is not limited to, the previously described alarm unit 10, fixed unit 50, display stand 130 and sensor 140.

Figure 6:
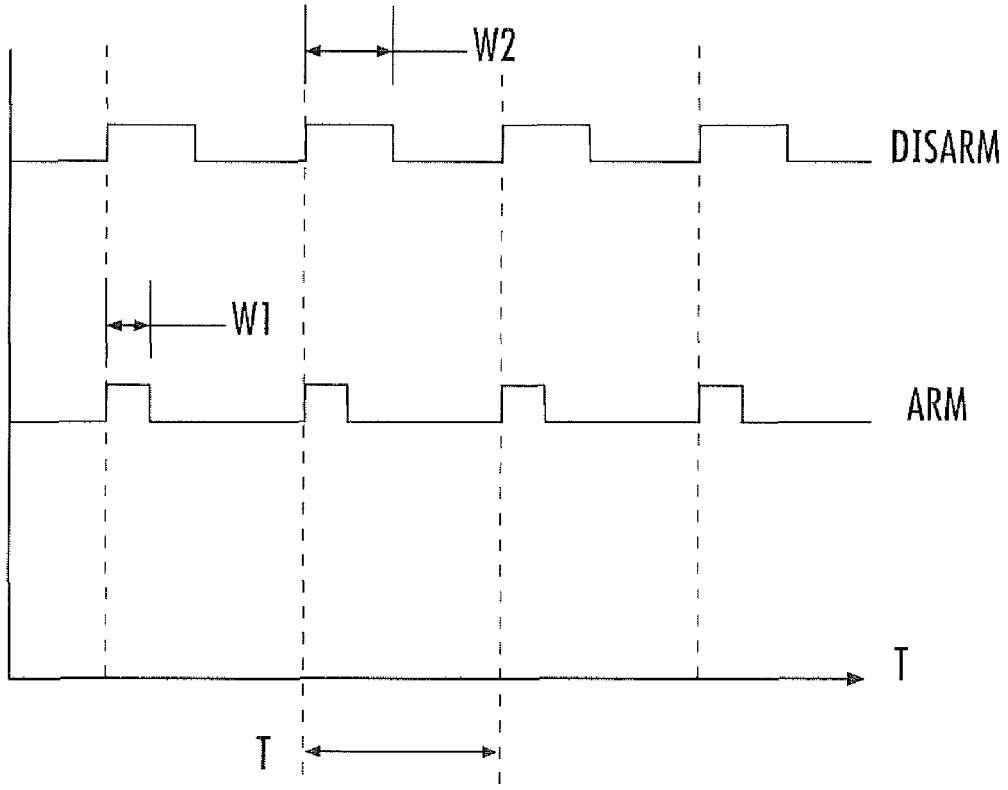
FIG. 6 depicts an exemplary embodiment of a data pattern for use with a merchandise display security device according to the present invention to control a first alarm and a second alarm using a single programmable key.

The data transmission and control circuit of a merchandise display security device according to the present invention may utilize preselected waveforms to arm and disarm the system and to program the control circuit. FIG. 6 shows an exemplary embodiment of a data pattern that is useful in the present invention for arming and disarming a merchandise display security device that encompasses a closed circuit for data transmission between components of the merchandise security system by way of a programmable key. The closed circuit allows a user to control the entire merchandise security system using a single programmable key to initially communicate with a programmable alarm module contained within one component of the system. The closed circuit further allows for monitoring changes in the status of conductors, switches, and alarms within the system. The closed circuit is, therefore, a sensing circuit that activates one or more alarms upon certain predetermined alarm conditions (e.g., severing a cable electrically connecting components of the security system ceases data transmission and opens the circuit, a condition which activates an alarm).

In one embodiment, arming and disarming the merchandise security system is initiated with input data from an external source, such as a programmable key communicating with a programmable alarm module via an arming port, such as arming port 43 shown in FIG. 1 or arming port 168 shown in FIG. 5. The programmable alarm module transmits an operating signal, for example an electronic pulse, which returns to the programmable alarm module through the closed circuit between components of the merchandise security system. In the embodiment of the merchandise display security device shown in FIG. 5, the operating signal originates in the display stand 130 and is transmitted through cable 75 to the sensor 140 before returning via the closed circuit to the display stand 130.

The merchandise display security device utilizes the input operating signal in multiple ways to monitor the merchandise security system. Utilizing the merchandise display security device shown in FIG. 6 as an example, a signal W1, having a pulse width of about forty (40) microseconds, is transmitted by a programmable alarm module circuit disposed in the display stand 130 to an alarm 190 (FIG. 9) housed within the sensor 140. Upon receiving the signal W1 via the closed circuit between the system components, the sensor 140 is armed to activate an audible alarm upon predetermined alarm conditions. In one embodiment, after receiving signal W1, the sensor 140 expects to receive signal W1 continuously to remain in the armed condition. Upon receiving a different signal or no signal at all, the sensor 140 is programmed for a predetermined output. For example, if the sensor 140 does not receive the expected signal W1 or any other signal, an open circuit condition exists (i.e., a conductor has been cut or a proximity switch has been actuated to the opened state), and as a result, the alarm 190 in the sensor 140 will be activated.

As further shown in FIG. 6 as an example, a signal W2, having a pulse width of about eighty (80) microseconds, is transmitted from the programmable alarm module circuit in the display stand 130 to the alarm 190 in the sensor 140 to disarm the security system. Upon receiving the signal W2, the sensor 140 is programmed to disarm (i.e., shut-down). Once a disarm condition exists, the security system can only be put back into the armed condition by transmitting the signal W1 once again to the sensor 140. Although the electronic pulse data pattern depicted in FIG. 6 is utilized in this exemplary embodiment, other suitable signal types and arrangements known within the art may be utilized to supply this anti-feature of the present invention.

As briefly noted above, FIGS. 5-9 depict a third exemplary embodiment of a merchandise display security device according to the present invention. FIG. 5 shows a front perspective view of this alternative embodiment having a generally vertical orientation for elevating an item of merchandise for enhanced display. FIG. 5 illustrates numerous details of this embodiment, but relative to the present invention, a base 101 houses an extensible and retractable breakaway cable 75 connected at one end to the base 101. The other end of the breakaway cable 75 connects to a sensor 140 that is configured to attach to an item of merchandise 141.

The base 101 comprises a portion of the display stand 130 supporting the sensor 140. As shown in FIG. 5, the base 101 secures the display stand 130 with at least one fastener to a rigid fixed support, such as a shelf, desk, countertop or table. Alternatively, the display stand 130 may be attached to the fixed support by an adhesive or other non-destructive means, such as a magnetically attractable plate secured to the underside of the display stand and a magnetized material disposed beneath the fixed support.

Figure 7:
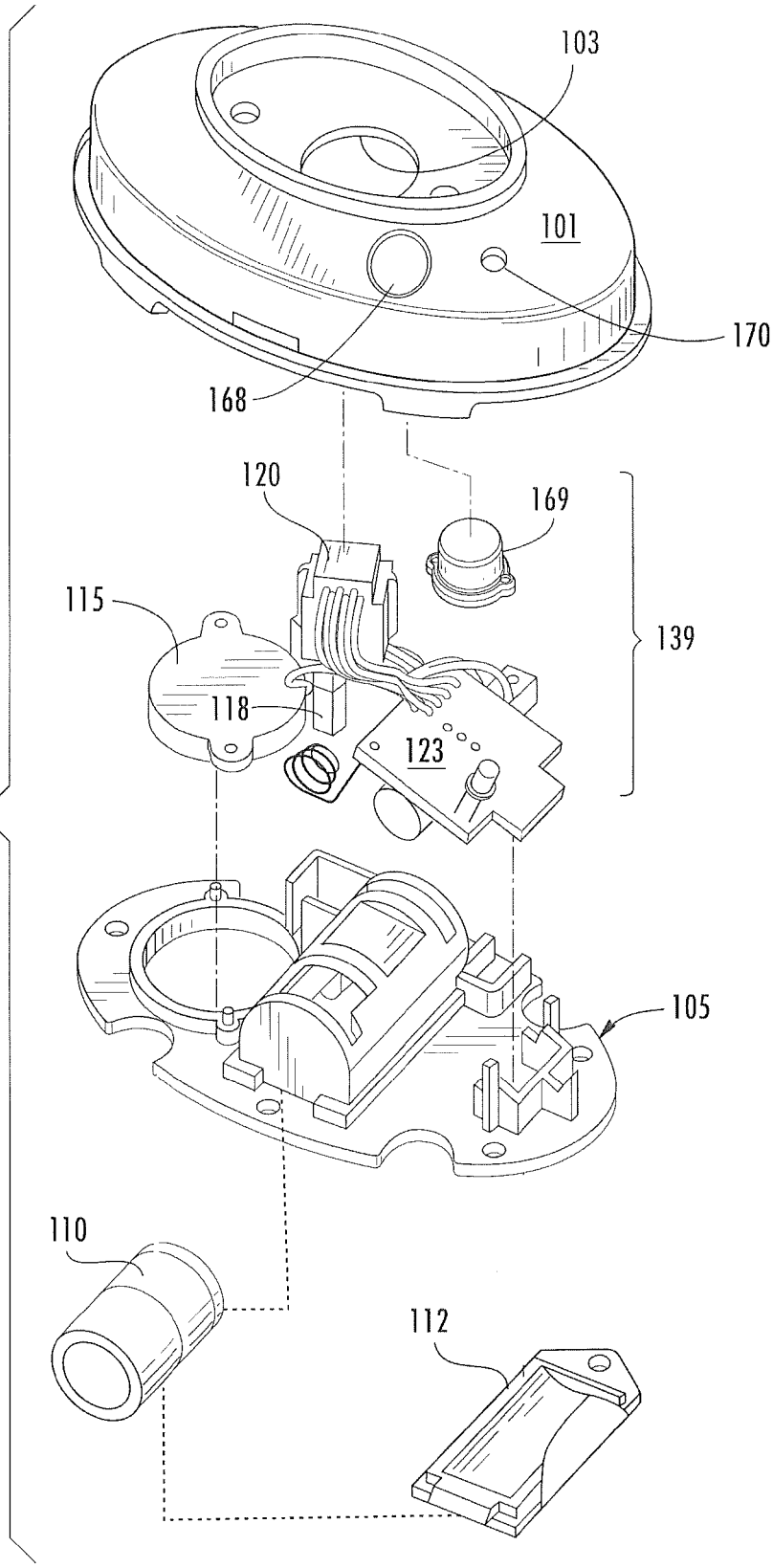
FIG. 7 is an exploded perspective view of the base portion of the merchandise display security device of FIG. 5.

In comparison to the previously discussed merchandise display security device of FIG. 4A, the base 101 may be considered to be a "fixed unit" that is more suitable for use with merchandise that potential customers pick up to examine and operate, particularly handheld electronics, such as digital cameras, digital video recorders (DVRs), global positioning systems (GPS), mobile telephones (e.g. cellular phones), and the like. FIG. 7 shows that the base 101 contains a control circuit 139 including a printed circuit board microprocessor 123 mounted on a mounting plate 105 disposed within the interior of base 101. The mounting plate 105 of the base 101 further comprises a battery housing in which a battery 110 is secured by a battery door 112 and a fastener (not shown). Battery 110 is in contact with a pair of battery terminals on the microprocessor 123 for powering the electronics within the base 101. Control circuit 139 further comprises an LED which is operably connected to the printed circuit board microprocessor 123. The LED is visible through an opening 170 formed through an upper surface of base 101. An audible base alarm 115, such as a piezoelectric alarm, is connected to microprocessor 123 and is located within a substantially circular opening formed in mounting plate 105. The control circuit 139 is also electrically connected to a plunger switch 118 disposed within base 101. The plunger switch 118 includes a plunger extending through a hole in mounting plate 105 and is actuated (i.e., opened) when the base 101 is removed or lifted from the fixed support in the manner previously described.

In another embodiment, the base 101 may include multiple switches positioned around the outer perimeter on the bottom of the base 101, similar to the embodiment of the fixed unit 50 described above with reference to FIG. 3. Though not explicitly shown, the embodiment of base 101 shown in FIG. 7 incorporates by reference the additional disclosure noted above regarding multiple proximity, contact or limit switches (e.g., plunger switches) positioned on opposite sides of the base. In other words, the base 101 may be adapted to include additional plunger switches around the outer perimeter of the base 101 to defeat tampering from multiple angles, similar to the embodiment of fixed unit 50 described with reference to FIG. 3. The particular details of control circuit 139 and printed circuit board microprocessor 123 are not shown or described in further detail, but are well known in the security system art as being readily configured to activate base alarm 115 when the base 101 is subjected to unauthorized removal or lifting from the fixed support within the display area.

Alarm 115 disposed within the base 101 also produces an audible and/or visible alarm signal when the article of merchandise 141 is separated from the sensor 140, as will be described hereinafter with reference to FIG. 9, from a first secured position on the detachable carriage 144 of the sensor to a second unsecured position. The alarm 115 is likewise activated in the event the electrical connection between the display stand 130 and the sensor housing 145 is interrupted. An interruption of electrical communication may occur, for example, if the breakaway cable 75 is disconnected or severed. The alarm 115 may also be activated to produce the alarm signal in the event that a proximity switch 118 (see FIG. 7) disposed between the base 101 of the display stand 130 and the fixed support indicates that the merchandise display security device has been displaced or removed from the fixed support at the display area. In this manner, the alarm 115 produces the audible output if tampering occurs when the merchandise display security device is in the armed configuration.

As shown in FIG. 5, the display stand 130 further includes a pedestal 70 for receiving a post 153 of the sensor 140 within an opening formed in a cover 71 of the pedestal. The cover 71 is provided to close the top of the pedestal 70 and may be affixed to the pedestal by a plurality of fasteners, or by other suitable means. An arming port 168, positioned on the base 101 or on the pedestal 70, is in wireless communication with a logic control circuit on the microprocessor 123 disposed within the base 101. The arming port 168 is configured to receive an operating signal, for example an infrared (IR), a radio frequency (RF), or an electromagnetic or magnetic pulse generated by an energy source, for example a portable transmitter or programmable key. The arming port 168 receives the operating signal and transmits the operating signal to the logic control circuit initially to program, and then subsequently to arm and disarm, the merchandise display security device of the alternative embodiment depicted in FIG. 5.

A visible indicator, such as a light-emitting-diode (LED) 170 is provided on the base 101 or the pedestal 70 of the display stand 130 to indicate the "armed" or "disarmed" state of the merchandise display security device. As shown in FIG. 9, the sensor 140 may also include an LED 178A visible through a lens 178B within an opening 146 to indicate that the sensor is armed. Once the merchandise display security device has been programmed and armed, the sensor 140 need only be disarmed before the detachable carriage 144 can be detached from the sensor housing 145 without activating an audible or visible alarm.

Referring again to FIG. 5, the merchandise display security device further comprises an external power supply 72 for supplying electrical power to the item of merchandise 141. An electrical power cable 143 has a connector at one end for attachment to the base 101 of the display stand 130. Preferably, the power cable 143 extends through an opening formed in the fixed support for connection to the power supply 72 disposed beneath the fixed support. The sensor 140 is electrically connected to the power supply 72 through the display stand 130 by electrical conductors in breakaway cable 75 that extend between the base 101 of the display stand 130 and the post 153 of the sensor. The sensor 140 further includes an electrical power cable 142, commonly referred to as "an adapter cable" or "pigtail" that is attached at one end to the sensor housing 145 and has a standardized connector at the other end for electrically connecting to the item of merchandise 141. Cable 142 is adapted to provide electrical power at an appropriate voltage to the item of merchandise and/or maintain a constant electrical charge on a battery or power pack for powering the item of merchandise. In this manner, a potential purchaser may examine and operate the item of merchandise 141 in a powered state. The display stand 130 or the sensor housing 145 may comprise known electronics for regulating (i.e., adjusting, such as stepping down) the voltage provided by the power supply 72 to a voltage suitable for use with the particular type and brand of merchandise 141. Furthermore, the cable 142 is provided with a connector configured for use with the particular type and brand of merchandise 141. Likewise, the display stand 130 or the sensor housing 145 may be sized to accommodate a power supply and/or any additional electronics needed for providing power to the item of merchandise 141.

Figure 8:
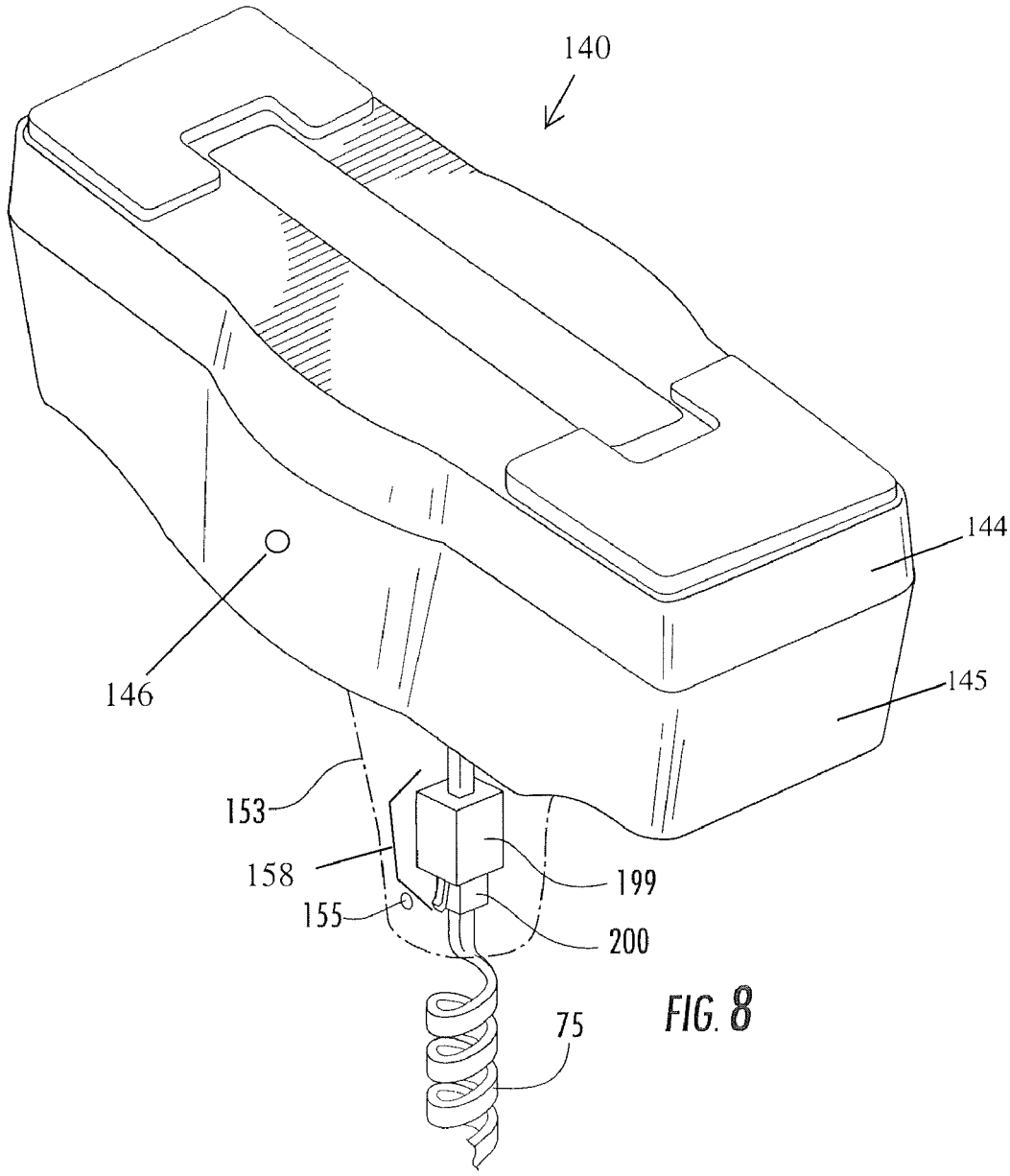
FIG. 8 is a perspective view showing an exemplary embodiment of a sensor having a post that serves as a shroud for a registered jack (RJ) connection with the merchandise display security device of FIG. 5.

The breakaway cable 75 can be mechanically and electrically secured between a base connector 120 (see FIG. 7) and sensor 140 through the cable cavity 103 formed in the interior of the base 101 and pedestal 70 by various attachment means, including use of an RJ plug 200 and an RJ jack 199 (see FIG. 8). The RJ plug 200 and RJ jack 199 collectively form an RJ connection 158 that can be used at either end of the breakaway cable 75 (i.e., an RJ connection 158 may be utilized to connect the breakaway cable to both the base 101 and the sensor 140). A resilient relief grommet (not shown) may be fitted around the RJ connection 158 at either end to provide strain relief so that the mechanical and electrical connection will be broken if a preselected separating force is applied to the RJ connection. As previously discussed with reference to FIG. 1, the preselected separating force may be determined such that the RJ connection 158 separates when a force within the range of about 10 pounds to about 20 pounds is exerted in a direction opposite the force retaining the RJ plug 200 within the RJ jack 199 at the RJ connection 158 of the breakaway cable 75 to the sensor 140. The RJ connection 158 may be specifically designed to separate at forces within a predetermined range in order to provide the breakaway anti-feature of the present invention. In this regard, a thief attempting to steal the item of merchandise 141 may separate the sensor 140 and merchandise from the breakaway cable 75, or alternatively, may separate the sensor 140, the item of merchandise 141 and the breakaway cable 75 from the base 101. Of course, a sensor alarm 190 (FIG. 9) within the sensor 140 will be activated upon disruption of the closed circuit discussed above. The sensor 140, therefore, is used in a similar manner as the alarm unit 10 of the exemplary embodiments of FIG. 4A and FIG. 4B. In this regard, the sensor 140 remains attached to the item of merchandise 141 while the sensor alarm 190 is activated, such as when a potential shoplifter attempts to remove the item of merchandise from the display area.

Accordingly, a merchandise display security device of this type is useful to display an item of merchandise 141, while allowing a potential purchaser to closely examine and operate the merchandise by extending the breakaway cable 75 to extract the sensor 140 and the item of merchandise from the base 101. The potential purchaser lifts the sensor 140 along with the item of merchandise 141, but the sensor and merchandise remain physically connected to the base 101 by the breakaway cable 75. In this regard, the sensor 140 is similar in function to the alarm unit 10 of the exemplary embodiments of FIG. 4A and FIG. 4B. In addition, the sensor 140 further includes electrical power cable 142 for electrically connecting to and providing power to the merchandise 141. In this manner, the potential purchaser can examine and operate the item of merchandise 141 in its powered state. If the potential purchaser attempts to remove the item of merchandise 141 from the display area, an alarm sounds in either the base 101, or the sensor 140, or both.

Figure 9:
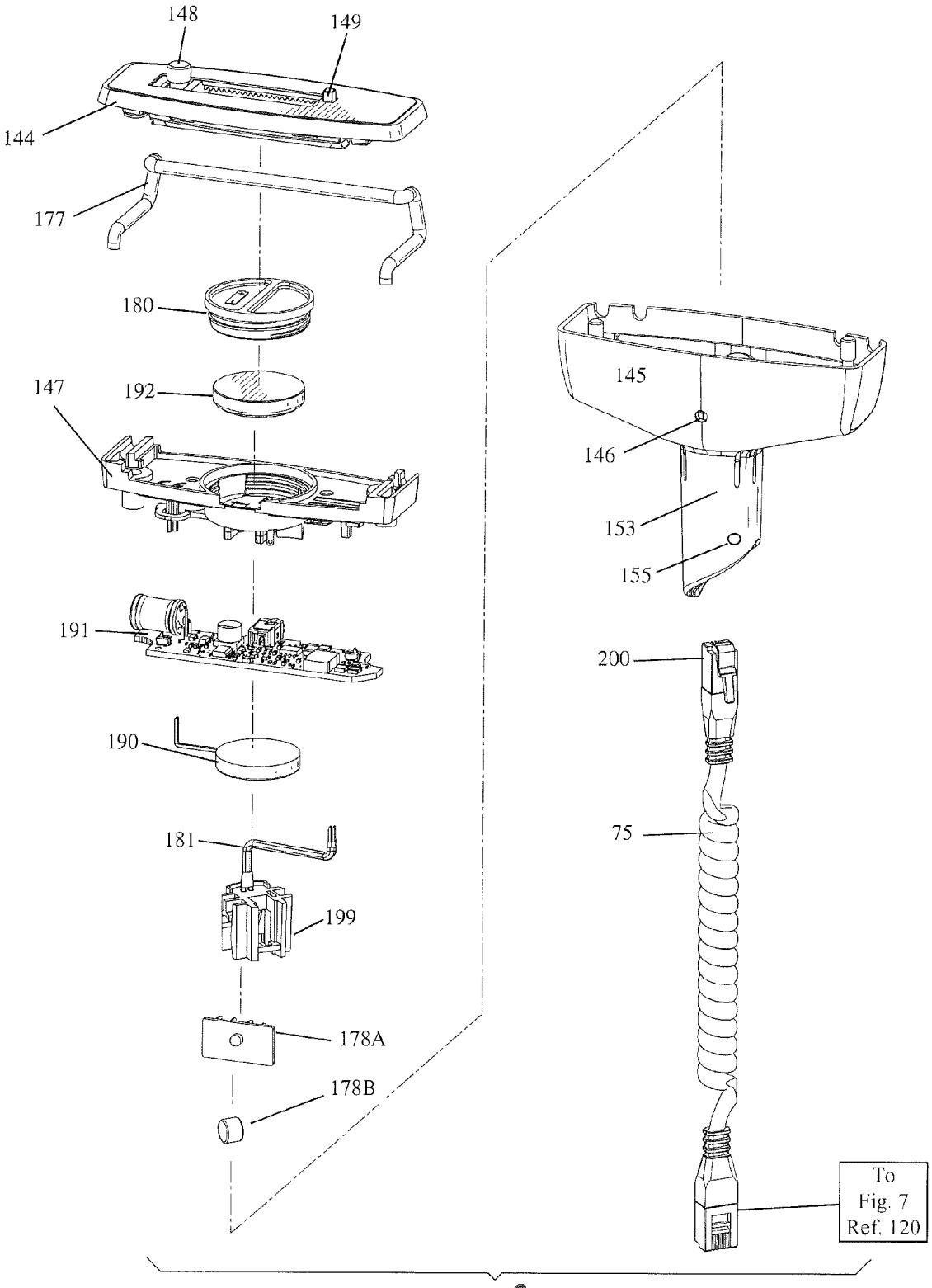
FIG. 9 is an exploded perspective view of another exemplary embodiment of a sensor for use with the merchandise display security device of FIG. 5.

FIG. 9 shows the sensor 140 of the merchandise display security device in an exploded view. The sensor 140 includes the detachable carriage 144 having an anchor fastener 148, such as a threaded screw, for attaching the article of merchandise 141 to the detachable carriage. The detachable carriage 144 defines a longitudinal channel along which the anchor fastener 148 moves (i.e., slides) to varying positions that allow the detachable carriage to accommodate different types and brands of merchandise having different locations of an internally threaded recess for engaging the anchor fastener 148. Accordingly, the adjustable position of the anchor fastener 148 provides a means for attaching multiple items of merchandise 141 to the same sensor 140. The detachable carriage 144 is configured to be releasably attached by a clip 177 to a bottom cover 147 of the sensor 140.

As further shown in FIG. 9, the sensor 140 includes a contact, limit or proximity switch 149 for indicating when the item of merchandise 141 is displaced from a first secured position on the detachable carriage 144 of the sensor 140 to a second unsecured position, or when the detachable carriage 144 is detached from the sensor housing 145.

The sensor 140 is removably disposed on the display stand 130 by a post 153, as best seen in FIG. 9, that depends downwardly from the sensor housing 145. In other embodiments, the post 153 may be configured to permit rotational movement of the sensor 140 relative to the display stand 130, or may be configured for rigid placement of the sensor on the display stand. If desired, the post 153 may be self-aligning by means of, for example, a mechanical alignment or a magnetic alignment mechanism, in order to orient the sensor 140, and consequently the item of merchandise 141, in a predetermined desirable orientation relative to the display stand 130.

The post 153 is designed to prevent a potential shoplifter from tampering with the RJ connection 158 (FIG. 8) to avoid an alarm condition. The post 153 serves as a shroud for the RJ plug 200 and RJ jack 199 connecting the breakaway cable 75 to the control circuit 191 of the sensor 140 via conductors 181. In one embodiment, the RJ plug 200 is received within the post 153 and, when the connection to the RJ plug 199 is made, the post 153 surrounds and overlaps the entire RJ connection 158. When the RJ connection 158 is completed within post 153, the resilient snap-in feature of the RJ plug 200 may only be depressed to remove the RJ plug through the use of a special tool (not shown) designed for insertion into an opening 155 formed through the post 153.

The item of merchandise 141 and the detachable carriage 144 cannot be detached from the sensor housing 145 of the sensor 140 without causing the base alarm 115 and the sensor alarm 190 to be activated unless the merchandise display security device is first disarmed through use of the arming port 168. The control circuit 191 of sensor 140 is programmed to provide an appropriate alarm signal upon predetermined alarm conditions. The logic control circuit of the microprocessor 123 of the base 101, or the control circuit 191 of the sensor 140, may be configured to provide a predetermined amount of time for removal and replacement of the detachable carriage 144. Alternatively, the logic control circuit of the microprocessor 123, or the control circuit 191, may be configured to require the merchandise display security device to be disarmed through the arming port 168 by a programmable key in cases where the merchandise display security device and the programmable key have each been programmed with the same security disarm code (SDC).

In the armed position, plunger switch 118 (see FIG. 7) within base 101, the sense loop through the conductors of the breakaway cable 75, and switch 149 (see FIG. 9) within the sensor 140 will activate base alarm 115 and sensor alarm 190, respectively, upon the unauthorized removal of the base from the fixed support at the display area, upon severing or forceful removal of the breakaway cable 75, or upon the unauthorized separation of the item of merchandise 141 from the sensor 140. Such a "dual alarm" merchandise security system provides additional protection for items of merchandise being displayed at a display area of a retail store and provides security personnel with additional tools for locating a shoplifter attempting to leave the display area with the stolen merchandise.

In this written specification and drawing figures, exemplary embodiments of the present invention have been disclosed with respect to merchandise security systems for displaying and protecting an item of merchandise, while deterring theft and preventing removal of the item of merchandise from a display area by an unauthorized person.

However, the present invention is not intended to be limited to the exemplary embodiments shown and described herein. It will be apparent to those skilled in the art that various modifications thereto can be made without departing from the spirit and scope of the invention. Unless otherwise noted, specific terms have been used in a generic and descriptive sense and not for purposes of limitation.

That which is claimed is:

1. A merchandise display security device for displaying and protecting an item of merchandise comprising:

an alarm unit configured to be attached to the item of merchandise;

a fixed unit configured to be attached to a fixed support; and a breakaway cable electrically connected between and mechanically attached to the alarm unit and the fixed unit, the breakaway cable having a preselected separating force for separating the breakaway cable from at least one of the alarm unit and the fixed unit that is less than a force that is sufficient to separate at least one of the alarm unit from the item of merchandise and the fixed unit from the fixed support.

2. A merchandise display security device according to claim 1, further comprising:

a releasable connection for connecting the breakaway cable to at least one of the alarm unit and the fixed unit, the connection having a resilient relief grommet for releasing the breakaway cable from the at least one of the alarm unit and the fixed unit upon application of the preselected separating force.

3. A merchandise display security device according to claim 2, wherein the preselected separating force is between about 10 pounds and about 20 pounds.

4. A merchandise display security device according to claim 2, wherein the alarm unit comprises a sensor having a post that surrounds the releasable connection.

5. A merchandise display security device according to claim 1, further comprising:

a first alarm disposed within the alarm unit; and a second alarm disposed within the fixed unit;

wherein at least one of the first alarm and the second alarm is activated upon the breakaway cable being electrically disconnected from the alarm unit and the fixed unit.

6. A merchandise display security device according to claim 5, wherein the first alarm is configured to emit a sound at a first frequency and the second alarm is configured to emit a sound at a second frequency that is different than the first frequency.

7. A merchandise display security device according to claim 1, further comprising a power cable electrically connected between the alarm unit and the item of merchandise.

8. A merchandise display security device according to claim 1, wherein the alarm unit comprises a sensor having an anchor fastener for attaching the item of merchandise to the alarm unit.

9. A merchandise display security device for displaying and protecting an item of merchandise comprising:

an alarm unit configured to be attached to the item of merchandise, the alarm unit comprising a first alarm configured to produce a first alarm signal;

a fixed unit configured to be attached to a fixed support, the fixed unit comprising a second alarm configured to produce a second alarm signal that is different than the first alarm signal; and a breakaway cable electrically connected between and mechanically attached to the alarm unit and the fixed unit;

wherein the alarm unit, the fixed unit and the breakaway cable define an electrical sense loop that activates at least one of the first alarm and the second alarm upon interruption of the sense loop.

10. A merchandise display security device comprising:

an alarm unit configured to be attached to an item of merchandise to be displayed and protected from theft;

a fixed unit in electrical communication with the alarm unit and configured to be attached to a fixed support; and a first alarm disposed within the alarm unit;

wherein at least one of the alarm unit and the fixed unit comprises a plurality of proximity switches proximate an outer perimeter thereof; and wherein actuating any one of the proximity switches activates the first alarm.

11. A merchandise display security device according to claim 10, wherein the proximity switches are positioned at different locations around the outer perimeter of the at least one of the alarm unit and the fixed unit.

12. A merchandise display security device according to claim 10, further comprising a breakaway cable that is electrically connected between the alarm unit and the fixed unit for providing the electrical communication between the fixed unit and the alarm unit, and that is mechanically attached to the alarm unit at a first end of the breakaway cable and to the fixed unit at a second end of the breakaway cable.

13. A merchandise display security device according to claim 10, wherein the first alarm is activated upon interruption of the electrical communication between the fixed unit and the alarm unit.

14. A merchandise display security device according to claim 10, wherein the fixed unit is in electrical communication with the alarm unit via a wireless data transmission interface.

15. A merchandise display security device according to claim 10, wherein the fixed unit is a second alarm unit comprising a second alarm.

16. A merchandise display security device according to claim 10, further comprising a power cable electrically connected between the alarm unit and the item of merchandise for providing power to the item of merchandise.

17. A merchandise display security device for displaying and protecting an item of merchandise comprising:

a base configured to be attached to a fixed support within a display area, the base comprising a base alarm configured to produce a first alarm signal; and a sensor in electrical communication with the base and configured to be attached to the item of merchandise, the sensor comprising a sensor alarm configured to produce a second alarm signal that is different than the first alarm signal.

18. A merchandise display security device according to claim 17, further comprising a power cable electrically connected between the sensor and the item of merchandise for providing power to the item of merchandise.

19. A merchandise display security device according to claim 17, further comprising an extensible breakaway cable electrically connected between and mechanically attached to the base and the sensor, the breakaway cable configured to extend outwardly from the base upon application of a lifting force and to retract back into the base upon release of the lifting force, the breakaway cable having a releasable connection on at least one end that releases the breakaway cable from at least one of the base and the sensor upon application of a preselected separating force that is greater than the lifting force.

20. A merchandise display security device according to claim 17 further comprising an arming port for receiving a data signal from an external source that is communicated between the base and the sensor.

21. A merchandise display security device according to claim 20, wherein the data signal is an arming signal that permits the security device to activate at least one of a base alarm having a first alarm signal and a sensor alarm having a second alarm signal that is different than the first alarm signal.

22. A merchandise display security device according to claim 20, wherein the data signal is a disarming signal that prevents the security device from activating at least one of a base alarm having a first alarm signal and a sensor alarm having a second alarm signal that is different than the first alarm signal.

* * * * *